United States Patent [19]

Comment

[11] Patent Number: 4,519,528

[45] Date of Patent: May 28, 1985

[54] LIQUID SPRAYING HEAD

[75] Inventor: Paul Comment, Courgenay, Switzerland

[73] Assignee: Guy Favrot, Oberengstringen, Switzerland

[21] Appl. No.: 207,974

[22] PCT Filed: Jan. 15, 1980

[86] PCT No.: PCT/CH80/00006

§ 371 Date: Sep. 19, 1980

§ 102(e) Date: Sep. 19, 1980

[87] PCT Pub. No.: WO80/01482

PCT Pub. Date: Jul. 24, 1980

[30] Foreign Application Priority Data

Jan. 22, 1979 [CH] Switzerland ..... 606/79

[51] Int. Cl.[3] ..... B05B 11/06

[52] U.S. Cl. ..... 222/396; 222/399

[58] Field of Search ..... 222/396, 399

[56] References Cited

U.S. PATENT DOCUMENTS 2,973,885 3/1961 Ferguson ..... 222/399

3,315,844 4/1967 Klasson et al. ..... 222/399 X

FOREIGN PATENT DOCUMENTS 1529193 5/1968 France .

2188566 1/1974 France .

1317627 5/1973 United Kingdom .

*Primary Examiner*—Joseph J. Rolla

*Assistant Examiner*—Frederick R. Handren

*Attorney, Agent, or Firm*—Robert E. Burns; Emmanuel J. Lobato; Bruce L. Adams

[57] ABSTRACT

The spray head consists of a body in which two similar superposed and coupled valves are mounted (16,27). The shank (12) of the upper valve is rigid with a control knob (5) provided with a nozzle (14). The body further encloses a pressure-reducing device. The body has an orifice (36) connecting a compressed-gas reservoir to the lower valve, an orifice connecting the pressure-reducing device to the vessel and an orifice (23) connecting the vessel to the upper valve. The pressure-reducing device comprises a slide-type regulation valve. The spray head may be secured detachably or not to the compressed air reservoir, and also to the vessel.

9 Claims, 8 Drawing Figures

LIQUID SPRAYING HEAD

The present invention has for its object a liquid spray head adapted to be connected to a compressed-gas reservoir and to be secured to a vessel containing the liquid to be atomized.

It is known to use a compressed gas in the same vessel as the liquid in order to atomize this liquid in the form of an aerosol. The gas utilized is fluorinated hydrocarbon known more particularly under the trademark Freon. Since the dangers inherent to the use of this gas have been acknowledged, many research works have been undertaken for finding a substitute gas. However, for certain applications, even such a gas, if it exists, could not be utilized validly. This is the case notably of perfumes of which the properties are destroyed when they are mixed with a compressed gas.

The present invention has for its scope of providing a spray head adapted to utilize any neutral gas other than Freon and capable of maintaining a controlled low pressure within the vessel containing the liquid to be atomized.

The spray head according to the invention is characterized by the fact that it consists of a body in which two similar superposed and coupled valves are mounted, each valve being provided with a spring and a hollow, movable control shank, known per se, acting both as an outlet conduit for the valve, the upper shank being rigid with a control knob actuatable by pressure and provided with a nozzle connected to the conduit of the hollow shank, a pressure-reducing and regulating device and a safety device, the body having a first inlet orifice adapted to connect the compressed-gas reservoir to the lower valve, an outlet orifice adapted to connect the pressure-reducing device to the vessel, a second inlet orifice adapted to connect the vessel to the upper valve and a conduit connecting the lower valve to the pressure-reducing device. With this head it is possible for instance to utilize a reservoir containing a gas compressed to 10 bars or more and to atomize the liquid with a controlled and regulated pressure of 0 to 3 bars or more, this low pressure being adjustable and maintained at an accurately defined value by means of the pressure-regulating pressure-reducing device. The valve coupling ensures the proper operation, without any loss, of the head and permits enclosing the complete assembly of the head components in a low volume cylindrical body adapted to be mounted on or in a vessel or bottle of standard size. The reservoir may be secured under the head and introduced therewith into the vessel or secured around the head externally of the vessel. The body may furthermore comprise means for plugging same to a vessel also enclosing the compressed-gas reservoir. The vessel may be made of metal as well as of glass.

The spray head according to the invention may be used for atomizing any liquid.

The attached drawing illustrates, by way of example, a form of embodiment of the invention.

The head comprises a cylindrical body 1 in which a set of valves 2, a pressure-regulating pressure-reducing device 3 and a safety device 4 are mounted.

Figure 1:
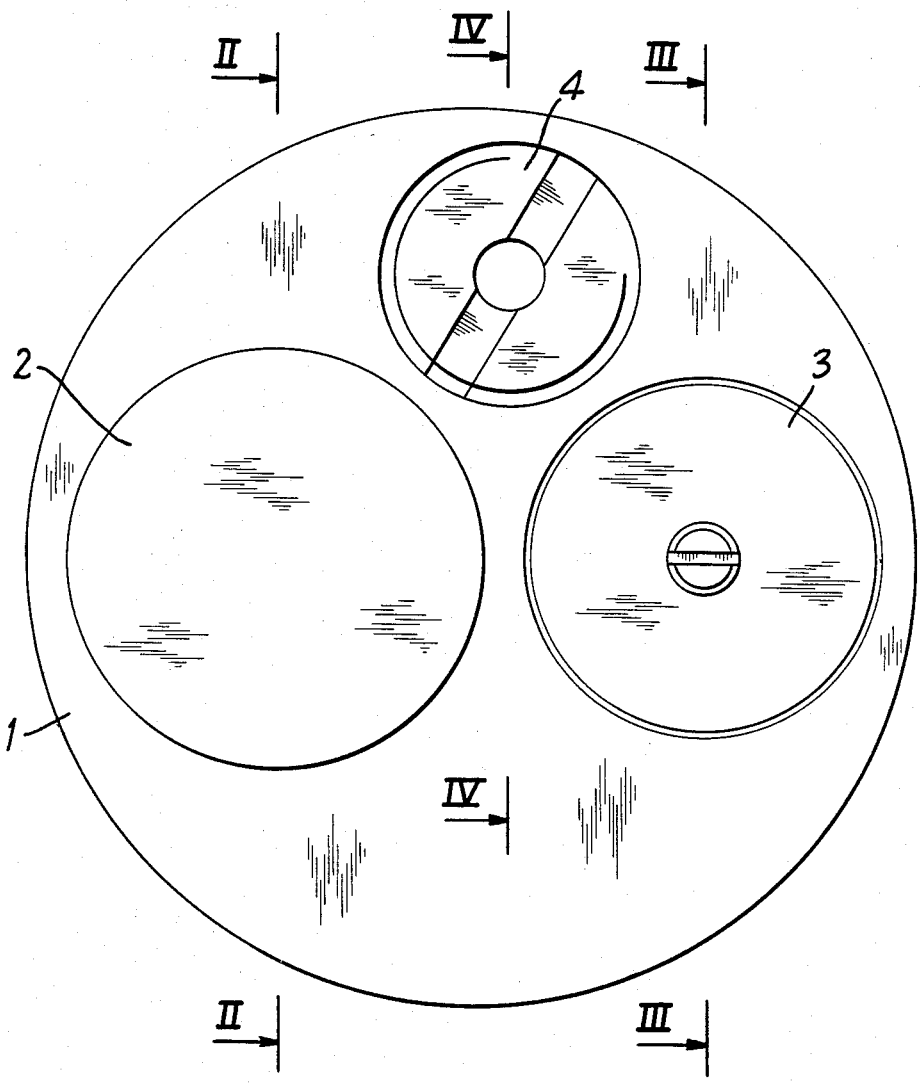
FIG. 1 illustrates a top plan view of a spray head in accordance with the invention.
Figure 2:
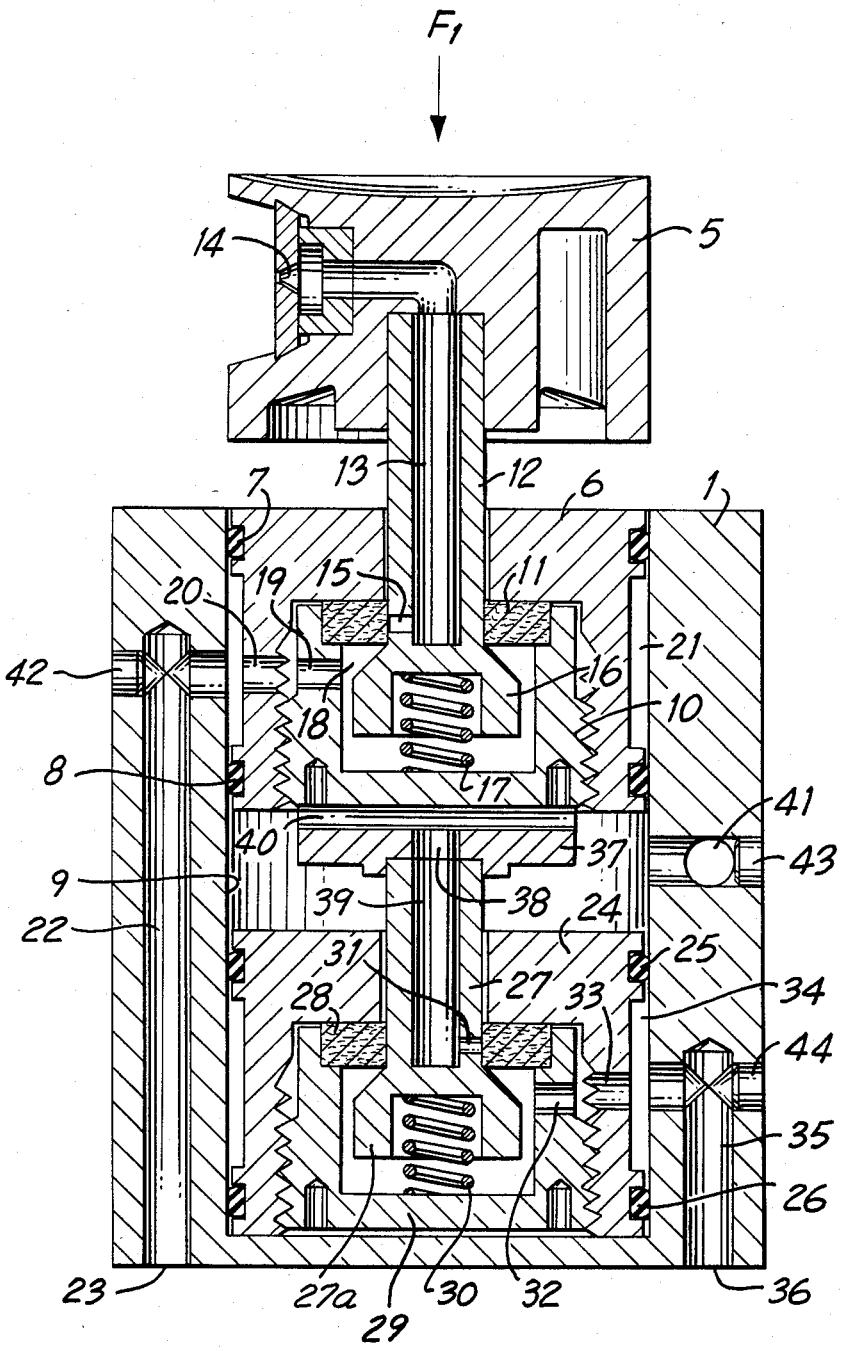
FIG. 2 illustrates a section thereof, taken along the line II—II of FIG. 1.

The valve assembly 2 is illustrated in FIG. 2. It consists of a pair of identical valves, superposed and controlled by means of a single push-button 5. These two valves are of the type utilized in aerosol cans. The upper valve comprises a valve body 6 provided with a pair of O-ring seals 7 and 8 enabling it to slide in a bore while warranting a sufficient fluid-tightness in the bore section underlying this body 6. Screwed in this body 6 is a gland 10 retaining a sealing packing 11 of synthetic material receiving therethrough a valve shank 12 provided with a central conduit 13 connected in its upper portion to a dispensing nozzle 14 formed in the button 5 and to the inner space of the valve body through a lateral hole 15 sealed in the inoperative condition by the packing 11. The shank 12 has formed at its lower portion an enlargement 16 through which, when inoperative, it abuts the packing 11 due to the force of a compression spring 17 disposed between the shank 12 and the bottom of gland 10. The chamber 18 formed within the hollow gland 10 communicates through a hole 19 with the inner space of the valve body 6. The inner space of body 6 communicates through a hole 20 with an annular chamber 21 surrounding the body 6 between the O-ring seals 7 and 8. This annular chamber 21 communicates in turn via a conduit 22 with an inlet orifice 23 opening into the lower portion of body 1.

The lower valve is identical with the upper valve and comprises like it a body 24 provided with a pair of O-ring seals 25 and 26, a hollow shank 27 with an enlargement **27*a*, a packing 28, a gland 29 and a spring 30. There are likewise three orifices 31,32 and 33 an an annular chamber 34 communicating with a conduit 35 connected to a first inlet orifice 36. The inlet orifice 23 will be referred to hereinafter as the second inlet orifice. Secured to the lower face of the gland 10 of the first valve is a plate 37 provided with a central hole 38 communicating with the conduit 39 of valve shank 27. The plate 37 further comprises a radial milling 40 on its upper face which provides a conduit whereby the hole 39 communicates with the inner space of bore 9 connected in turn to a conduit 41**.

The various elements described may be made either of metal or of synthetic material. In the embodiment described metal and known synthetic materials are used partially. From FIG. 2 it appears that when a pressure is exerted in the direction F1 upon the button 5, the shank 12 is caused to move downwards and, through its spring 17, carries along the valve body 6 by pushing the valve shank 27 of the lower valve while compressing its spring 30. To compress the spring 30, i.e. open the lower valve, it is therefore necessary to overcome through the medium of spring 17 the frictional resistance of the body 6 in the bore 9 and the frictional force of the valve shank 27 in its packing 28. Since the springs 17 and 30 are identical, the upper valve opens with a slight lead with respect to the lower valve. When the button 5 is released, the same frictions have the effect that the upper valve closes with a slight lead with respect to the lower valve. As one will become aware in a later part of the description, this slight shift exerts a favourable effect since it prevents an untimely exhaust of the compressed gas.

The conduits are formed by drilling along perpendicular axes and stopping the orifices not used by the plugs such as 42, 43 and 44.

Figure 3:
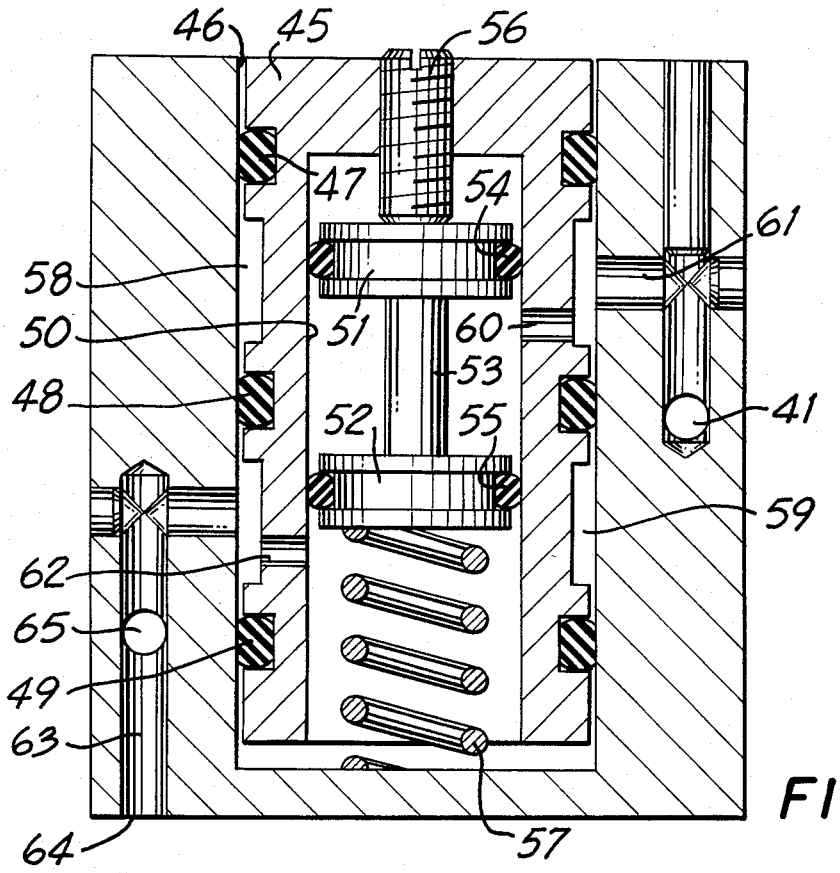
FIG. 3 illustrates a section taken along the line III—III of FIG. 1.
Figure 4:
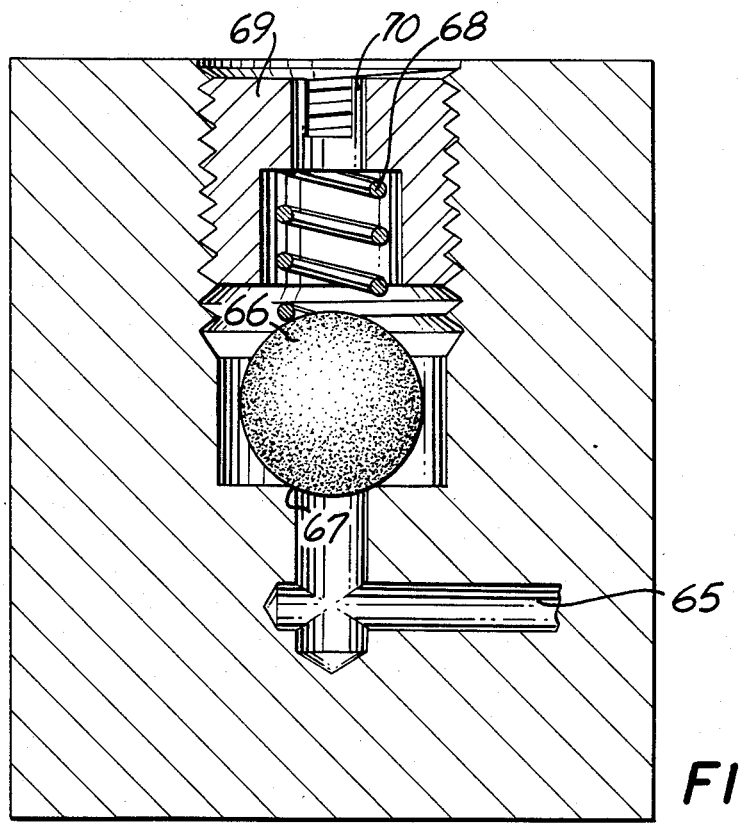
FIG. 4 illustrates a fragmentary sectional view thereof, taken along the line IV—IV of FIG. 1.

The pressure-regulating pressure reducing device 3 as shown in FIG. 3 comprises a valve body 45 which fits fluid-tight in a bore 46 in the head 1 by means of three O-ring seals 47, 48 and 49. This valve body 45 comprises in turn a bore 50 in which two pistons 51 and 52 are mounted, these pistons being rigidly interconnected by a rod 53 and each provided with a piston-ring consisting of O-rings 54 and 55. The double piston 51/52 is held in abutment against a screw 56 by a spring 57 reacting against the bottom of bore 46. On the outer periphery of valve body 45 two annular chambers 58 and 50 are machined, the first one between seals 47 and 48, and second one between seals 48 and 49. The chamber 58 communicates with space 50 through a port 60 and is connected to the conduit 41 through a conduit 61. The chamber 59 communicates with the portion of bore 50 underlying the pistons by means of a port 62 and is furthermore connected to a conduit 63 leading to an outlet orifice 64 and to a conduit 65 leading to the safety device illustrated in FIG. 4. This safety device as shown in FIG. 4 is a valve consisting of a rubber ball 66 urged against its seat 67 by a spring 68 of which the pressure is adjustable by means of a screw 69 having an axial hole drilled therethrough.

Figure 5:
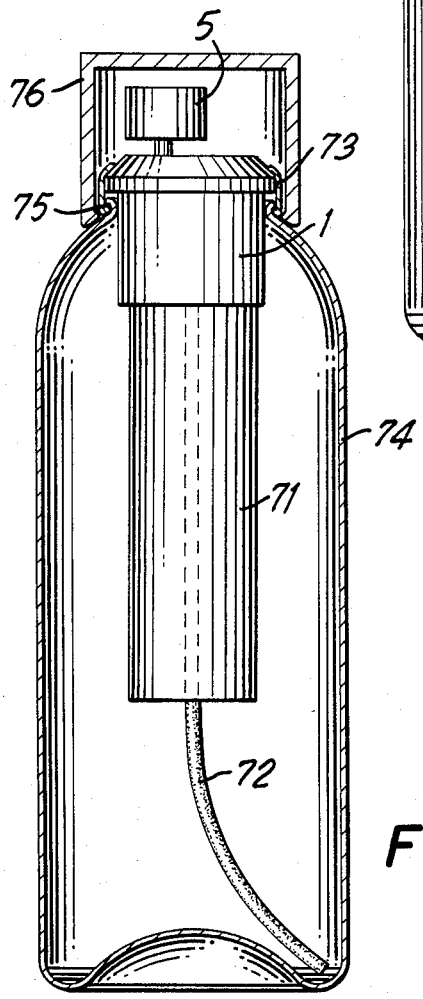
FIG. 5 illustrates a first mounting of the head.

The device is utilized for example as illustrated in FIG. 5. It is rigid with a compressed-gas reservoir 17 secured under the head and communicating through the first inlet 36 with the valves (FIG. 2). The second inlet 23 is connected to a plastic dipper tube 72. The head is secured by means of a ring 73 crimped to the neck of a metal container 74 with the interposition of a seal 75.

The outlet orifice 64 opens freely into the vessel. The latter is provided with a detachable cap 76.

By means of the pressure-regulating pressure-reducing device 3 it is possible to keep at a constant value the pressure within the container, for example 1.1 bars when the pressure-reducing device is connected to the reservoir filled with compressed gas, for example air or nitrous oxide, under a wide pressure range from at least 5 to 12 bars. In FIG. 3 the piston movement necessary for causing the chamber 50 to communicate with port 62 has been considerably exaggerated. In actual practice, it is possible to obtain a very slight movement of this piston which permits of producing the regulation. Since the conduit 61 is connected to the compressed-gas reservoir, the position of the double piston 51/52 is adjusted by means of screw 56 so as to obtain the desired pressure in the container. The result obtained is quite surprising and unexpected. Unfortunately, since all the prototypes constructed are made of metal and therefore opaque, it has not been possible to ascertain which is the position of piston 52 at the regulation point. Maybe the O-ring seal 55 of this piston is already at the level of port 62, so that this port communicates through a very narrow passage with chamber 50. Thus, one would have a considerable reduction in the pressure of the gas flowing from conduits 41 and 61 into chamber 50 through this narrow passage. In fact, one must consider that the compressed-gas reservoir is not connected permanently with chamber 50, but only when the valves are opened by depressing button 5. However, it should be pointed out that none of the known solutions afforded a satisfactory operation of the pressure-reducing regulating device and these results have been obtained only by adding the piston 51.

The operation of the spray head is evident from the drawings and the above description. When one depresses the button 5, one opens the two coupled valves. The compressed-gas reservoir is caused to communicate with the pressure-reducing device through conduit 35, annular chamber 34, holes 33, 32 and 31, conduit 39 of shank 27 and conduit 41. The expanded gas emerges from the pressure-reducing device through conduit 62, chamber 59, conduit 63 and orifice 64, and escapes into the container. The slight overpressure in the container causes the liquid to rise through the dipper pipe 72 into conduit 23. Then the liquid flows through orifices 20,19 and 15 for escaping through the nozzle 14.

As a variant, the valve body 45 of the pressure-reducing device could be suppressed, the bore 50 being then formed directly in the body 1.

Figure 6:
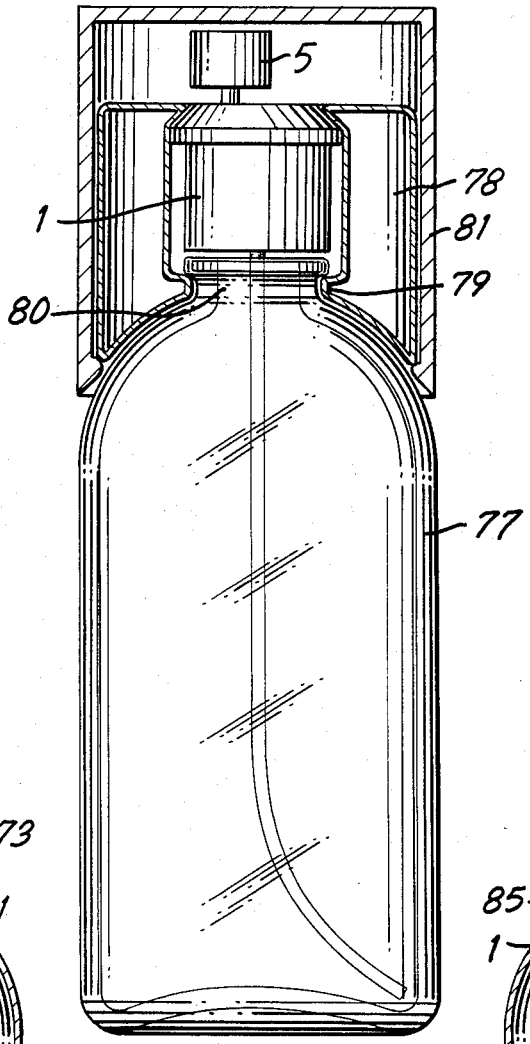
FIG. 6 illustrates a second mounting of the head.
Figure 7:
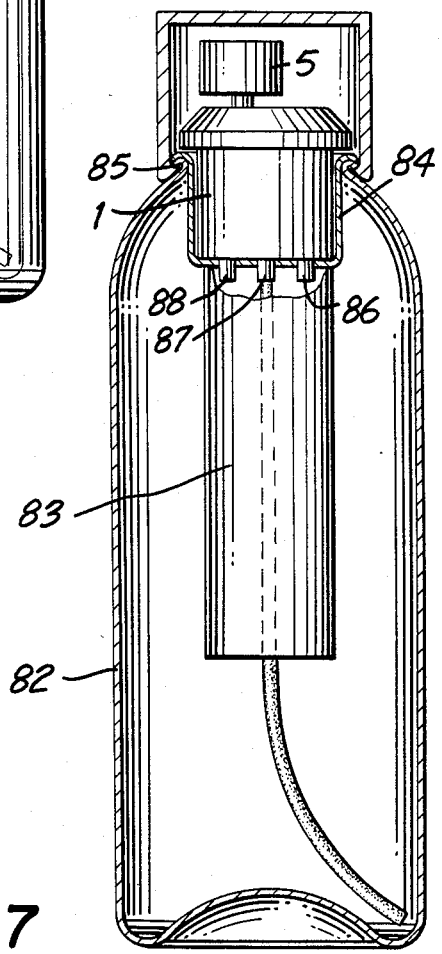
FIG. 7 illustrates a third mounting of the head.
Figure 8:
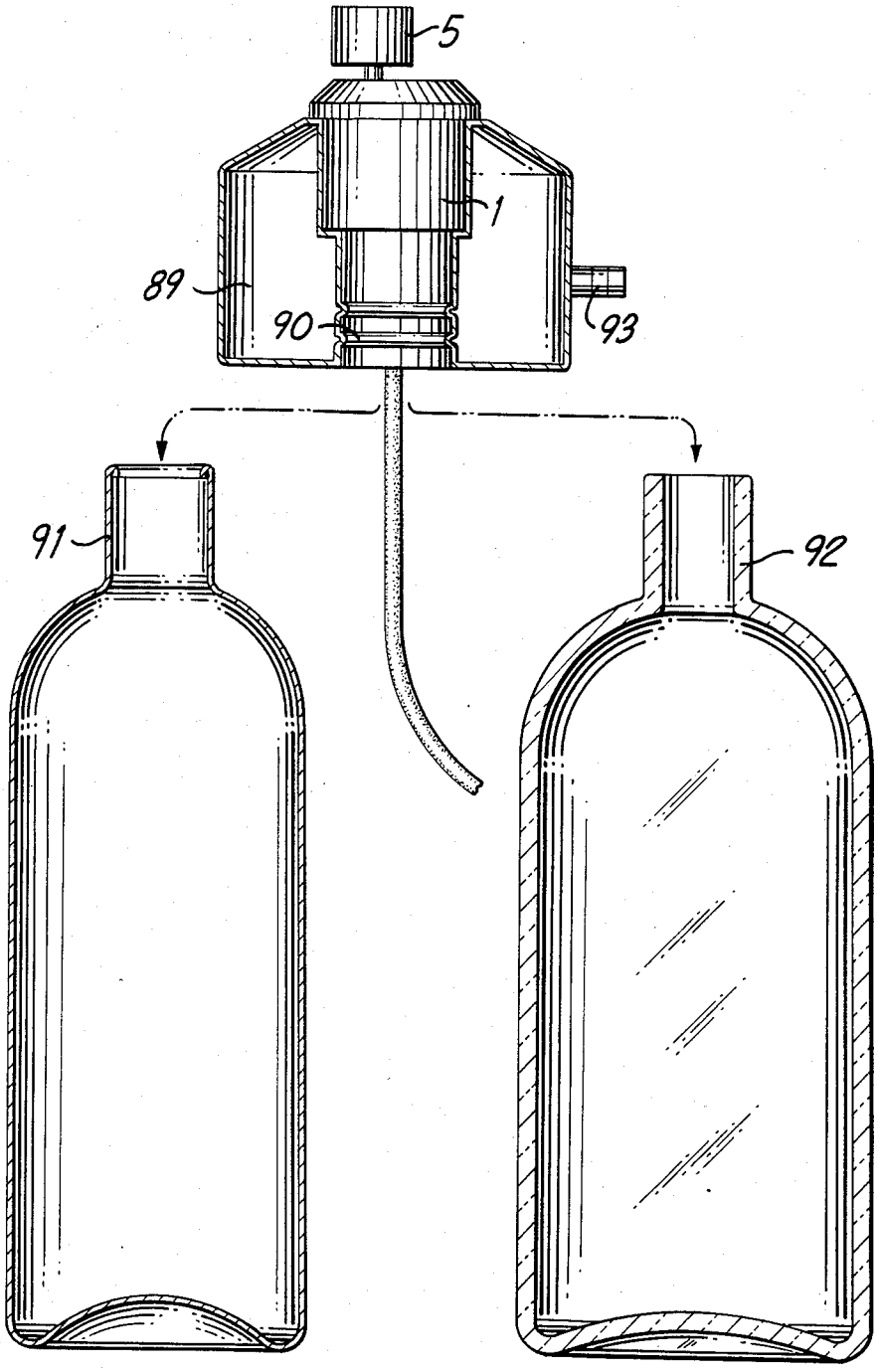
FIG. 8 illustrates a fourth mounting of the head.

FIGS. 6, 7 and 8 illustrate by way of example three other possibilities of mounting the head and the reservoir on or inside a container.

In the mounting illustrated in FIG. 6, the vessel 77 is made of glass. The reservoir 78 has an annular shape and surrounds the head 1 to which it is connected laterally. To this end a lateral drilling is utilized, the plug 44 sealing in this case the orifice 36. The reservoir 78 has a projection 79 permitting its snap fixation in the neck 80 of the vessel. The whole is concealed by a cap 81 retained by snap action on the reservoir. These arrangements permit of obtaining a satisfactory aesthetic appearance. In the case of a metal container, the mounting illustrated in FIG. 5 will be preferred, in which the compressed-gas reservoir is located inside the container and occupies therein a volume corresponding to the volume occupied by the Freon in aerosol dispensers.

In the mounting illustrated in FIG. 7 the container 82 is made of metal and contains the compressed-gas reservoir 83 secured to a cylindrical cup 84 secured by crimping 85 to the container aperture. The head 1 comprises, at its base, three studs 86, 87 and 88 constituting each an extension of the three original orifices and having the twofold function of maintaining the head on the container while providing the fluid-tightness necessary for this mounting and permitting the recovery of the head from an empty container for mounting same on another container.

In the mounting illustrated in FIG. 8 the head 1 is provided with an annular compressed-gas reservoir 89 having an extension beneath the head 1 in the form of a central ribbed portion 90 permitting the fixation of the reservoir to the neck 91 of a metal container or the neck 92 of a glass container. The reservoir 89 may be provided with a valve 93 permitting the recharging thereof or the continuous use of the device by connecting same to a source of compressed gas or other adequate arrangement. In this case the head, the reservoir as well as the container can be re-used.

According to a modified embodiment (not shown) the head is secured permanently to a reservoir through which conduits connecting the outlet orifice 64 and the inlet orifice 23 to orifices formed on the reservoir and provided with means for connecting same to a vessel extend. In this case the head and the reservoir can be re-used.

In certain cases it is possible to eliminate the reservoir by connecting the head directly to a compressed-air circuit constantly kept under pressure.

I claim:

1. A liquid spray head connected to a compressed-gas reservoir and adapted to be secured to a vessel containing a liquid to be atomized, said spray head comprising a body, means for securing said body to said vessel and for connecting said spray head to said compressed-gas reservoir, two superposed and coupled valves, a pressure-reducing expansion device and a safety device in said body, said superposed valves comprising an upper valve having a movable valve member comprising a hollow upper shank with a pushbutton and spray nozzle at its upper end, and a lower valve having a movable valve member comprising a lower shank aligned with but separate from said upper shank, spring means urging said lower shank toward said upper shank, and spring means interposed between said lower shank of said lower valve and said upper shank of said upper valve, said lower valve having an inlet connected with said compressed gas reservoir and an outlet connected with said pressure reducing expansion device, said pressure reducing expansion device having an inlet connected with said lower valve and an outlet connected with the interior of said vessel, and said upper valve having an inlet connected with a lower region of said vessel and an outlet connected through said hollow shank of said upper valve with said spray nozzle.

2. A liquid spray head according to claim 1, in which each of said valves comprises a valve body, and in which each of said valve shanks has at its lower end a conical enlargement cooperating with an annular sealing packing set in said valve body to close the respective valve when said valve shank is in released upper position.

3. A liquid spray head adapted to be connected to a compressed-gas reservoir and to be secured to a vessel containing a liquid to be atomized, said spray head comprising a body, means for securing said body to said vessel and for connecting said spray head to said compressed-gas reservoir, two superposed and coupled valves, a pressure-reducing expansion device and a safety device in said body, said superposed valves comprising an upper valve having a movable valve member comprising a hollow upper shank with a pushbutton and spray nozzle at its upper end, and a lower valve having a movable valve member comprising a lower shank aligned with but separate from said upper shank, and spring means urging said lower shank toward said upper shank, said lower valve having an inlet connected with said compressed gas reservoir and an outlet connected with said pressure reducing expansion device, and said upper valve having an inlet connected with a lower region of said vessel and an outlet connected through said hollow shank of said upper valve with said spray nozzle, said pressure-reducing expansion device comprising a cylinder bore, first and second pistons rigidly connected with one another in said bore, each of said pistons having an annular groove and an O-ring sealed in said groove and engaging the cylinder wall, compression spring means acting axially on said second piston, stop means limiting movement of said pistons by said spring means, an inlet orifice in said cylinder between said pistons and an outlet orifice in said cylinder adjacent said second piston in position to be partially opened to the space between said pistons upon movement of said pistons toward said spring means, said inlet orifice being connected with the outlet of said lower valve and said outlet orifice being connected with interior of said vessel.

4. A liquid spray head according to claim 3, in which said safety device comprises a valve seat, a conduit connecting said valve seat with the outlet orifice of said pressure-reducing expansion device, a ball adapted to seat on said valve seat, a compression spring for pressing said ball toward said valve seat with a selected pressure, and a screw screwed into a tapped hole in said body to retain said spring and adjust the pressure with which it presses on said ball, said screw having an axial bore opening to the atmosphere.

5. A liquid spray head according to claim 1, in which the spray head body is secured permanently to the compressed-gas reservoir.

6. A liquid spray head according to claim 5, in which the compressed-gas reservoir is secured to the lower side of the spray head body and is received in said vessel.

7. A liquid spray head according to claim 1, in which the compressed-gas reservoir is annular and surrounds the spray head body.

8. A liquid spray head according to claim 7, in which said spray head body and vessel are provided with cooperating means for removably securing said spray head body surrounded by said compressed-gas reservoir to said vessel.

9. A liquid spray head according to claim 1, in which said compressed-gas reservoir is mounted in said vessel and in which said vessel is provided with a receptacle to receive said spray head body and with means for connecting said spray head body with said vessel and said compressed-gas reservoir.

* * * * *